US007146676B2

(12) United States Patent
Kubes et al.

(10) Patent No.: US 7,146,676 B2
(45) Date of Patent: Dec. 12, 2006

(54) CLEANING DEVICE WITH DISPOSABLE PAD

(75) Inventors: Michael J. Kubes, Oakdale, MN (US); Perry S. Dotterman, Maplewood, MN (US); Mark D. Sorlien, White Bear Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 651 days.

(21) Appl. No.: 10/663,535

(22) Filed: Sep. 16, 2003

(65) Prior Publication Data

US 2005/0055789 A1 Mar. 17, 2005

(51) Int. Cl.
*A47K 7/02* (2006.01)

(52) U.S. Cl. ..... 15/244.1; 15/210.1; 15/220.1

(58) Field of Classification Search ..... None
See application file for complete search history.

(56) References Cited

U.S. PATENT DOCUMENTS

| | | | |
|---|---|---|---|
| 2,816,311 | A | 12/1957 | Beck et al. |
| 2,816,313 | A | 12/1957 | Beck et al. |
| 3,221,356 | A | 12/1965 | Schirmer |
| 3,383,158 | A | 5/1968 | Leland |
| 4,466,152 | A | 8/1984 | Moss et al. |

(Continued)

FOREIGN PATENT DOCUMENTS

EP 1 190 657 3/2002

(Continued)

OTHER PUBLICATIONS

Design Division Document No. HH08046492 from the Korean Industrial Property Office, published Jan. 18, 1996 in the *Korean Official Bulletin of Designs and Trademarks* (English translation attached).

*Primary Examiner*—David Redding
(74) *Attorney, Agent, or Firm*—Trisha D. Adamson

(57) ABSTRACT

A handle assembly for use with a fibrous cleaning pad. The handle assembly includes a generally rigid first member including a first insertable portion, and a handle portion with a first end of the handle portion fixed to a second end of the first insertable portion and a manually engageable part adjacent a second opposite end of the handle portion. The handle assembly also includes a second member including a second insertable portion, and an actuation portion having a first end fixed to a second end of the second insertable portion. A first end of the second insertable portion opposite the actuation portion is pivotally mounted on a first end of the first insertable portion opposite the handle portion for relative movement of the insertable portions by manual manipulation of the actuation portion between a diverging position with outer surfaces of the insertable portions diverging from their first ends, and an adjacent position with the outer surfaces of the insertable portions generally parallel. At least one of the insertable portions (and preferably both) has at least one barb projecting from its inner surface, and the other of the insertable portions has an opening aligned with that barb. The barb projects above the outer surface of the other of the insertable portions in the adjacent position of the insertable portions so that with the insertable portions in a slit in the cleaning pad the barb will engage the cleaning pad. The barb is essentially positioned between the outer surfaces of the insertable portions in their diverging position so that the insertable portions can move within the slit in the cleaning pad.

15 Claims, 7 Drawing Sheets

U.S. PATENT DOCUMENTS

| | | | |
|---|---|---|---|
| 4,493,124 | A | 1/1985 | Agapiou |
| 4,852,201 | A | 8/1989 | Wundrock et al. |
| 5,488,748 | A | 2/1996 | Koch |
| 5,592,713 | A | 1/1997 | Rones |
| 5,630,243 | A | 5/1997 | Federico et al. |
| 6,295,688 | B1 | 10/2001 | Sayles et al. |
| 6,611,986 | B1 | 9/2003 | Seals |
| 2002/0025213 | A1 | 2/2002 | Serna |
| 2002/0120993 | A1 | 9/2002 | Busha |
| 2004/0088808 | A1 | 5/2004 | Vitantonio et al. |

FOREIGN PATENT DOCUMENTS

| | | |
|---|---|---|
| JP | 10 211119 | 8/1998 |
| WO | WO 87/00022 | 1/1987 |
| WO | WO 01/15587 | 3/2001 |

CLEANING DEVICE WITH DISPOSABLE PAD

FIELD OF THE INVENTION

This invention relates to cleaning devices particularly including cleaning devices for cleaning toilet bowls that include reusable handle assemblies and disposable pads that are releasably engaged with the handle assemblies during use of the cleaning devices.

BACKGROUND OF THE INVENTION

The prior art is replete with cleaning devices for cleaning toilet bowls that each include a reusable handle assembly and a disposable pad that is releasably engageable with the handle assembly. U.S. Pat. Nos. 2,816,313; 3,221,356; 3,383,158; 4,466,152; 4,493,124; 4,852,201; 5,488,748; 5,592,713; 5,630,243; and 6,295,688; Published Patent Applications US 2002/0025213A1 and 2002/0120993A1; PCT Applications WO 87/00022 and WO 01/15587; and European Patent Application EP 1 190 657 A1 provide illustrative examples. The large number of patents and patent applications in this area is indicative of the amount of effort that has been expended to provide effective easily used cleaning devices for cleaning toilet bowls that require minimum contact with the disposable pad, particularly after the pad has been used.

DISCLOSURE OF THE INVENTION

The present invention provides a cleaning device, that while usable for other cleaning tasks, is particularly adapted for cleaning toilet bowls, which cleaning device includes a reusable handle assembly and a disposable pad that are easy to assemble, provide effective cleaning when assembled; and require little or no contact with the disposable pad to remove it from the handle assembly after the pad has been used.

According to the present invention there is provided a handle assembly for use with a fibrous cleaning pad having a slit opening through a side surface of the cleaning pad. The handle assembly includes a generally rigid first member including a first insertable portion having opposite inner and outer surfaces extending between first and second opposite ends, and a handle portion with a first end of the handle portion fixed to the second end of the first insertable portion and a manually engageable part adjacent a second opposite end of the handle portion. The handle assembly also includes a second member including a second insertable portion having opposite inner and outer surfaces extending between first and second opposite ends, and an actuation portion having a first end fixed to the second end of the second insertable portion. The first end of the second insertable portion is pivotally mounted on the first end of the first insertable portion with the inner surfaces of the insertable portions adjacent for relative movement of the insertable portions by manual manipulation of the actuation portion between a diverging position with the outer surfaces of the insertable portions diverging from their first ends, and an adjacent position with the outer surfaces of the insertable portions generally parallel or closer to parallel than in their diverging position. At least one of the insertable portions (and preferably both) has one or more barbs projecting from its inner surface, and the other of the insertable portions has an opening aligned with that barb. The barb or barbs project above the outer surface of the other of the insertable portions in the adjacent position of the insertable portions so that with the insertable portions in the slit in the cleaning pad the barbs will engage the cleaning pad. The barbs are positioned between the outer surfaces of the insertable portions in their diverging position so that the insertable portions can move into or out of the slit in the cleaning pad.

By manual manipulation of the actuation portion a user of the handle assembly can position the insertable portions either in their diverging position so that the cleaning pad can be moved onto or off of the insertable portions without contacting the barb or barbs, or can position the insertable portions in their adjacent position so that the barb or barbs will engage the cleaning pad when it is positioned on the insertable portions to retain the cleaning pad on the handle assembly while the cleaning device is being used for cleaning. When the insertable portions are moved to their diverging position while received in the slit in the cleaning pad the wedge-like position of the outer surfaces of the insertable portions can cause the cleaning pad to slide off of the insertable portions with little or no external contact with the cleaning pad so that the cleaning pad can be removed without being contacted by the user of the handle assembly.

The barbs can project at about right angles to the inner surfaces of the insertable portions in which case the insertable portions can be moved into or out of the slit in the cleaning pad with the insertable portions in their diverging position. Alternatively, the barbs can be inclined toward the second end of the insertable portions and shaped so that the insertable portions can be moved into the slit in the cleaning pad with the insertable portions in their adjacent position.

The handle assembly can be a generally rigid member manually moveable between a closed position laying along the handle portion to position the insertable portions in the adjacent position, and an open position spaced from the handle portion to position the insertable portions in the diverging position, and the handle assembly can include means for releasably latching the handle and actuation portions in the closed position. Alternatively the actuation portion of the handle assembly can be a mounted for sliding movement along the handle portion between a closed position to position the insertable portions in the adjacent position, and an open position with the first end of the actuation portion closer to the insertable portions than in the closed position to position the insertable portions in the diverging position. The actuation portion can include a manually engageable button moveable along the handle member to afford manual movement of the insertable portions between the adjacent and open positions.

BRIEF DESCRIPTION OF THE DRAWING

The present invention will be further described with reference to the accompanying drawings wherein like reference numerals refer to like or corresponding parts throughout the several views, and wherein.

DETAILED DESCRIPTION OF THE INVENTION

Figures 1, 2:
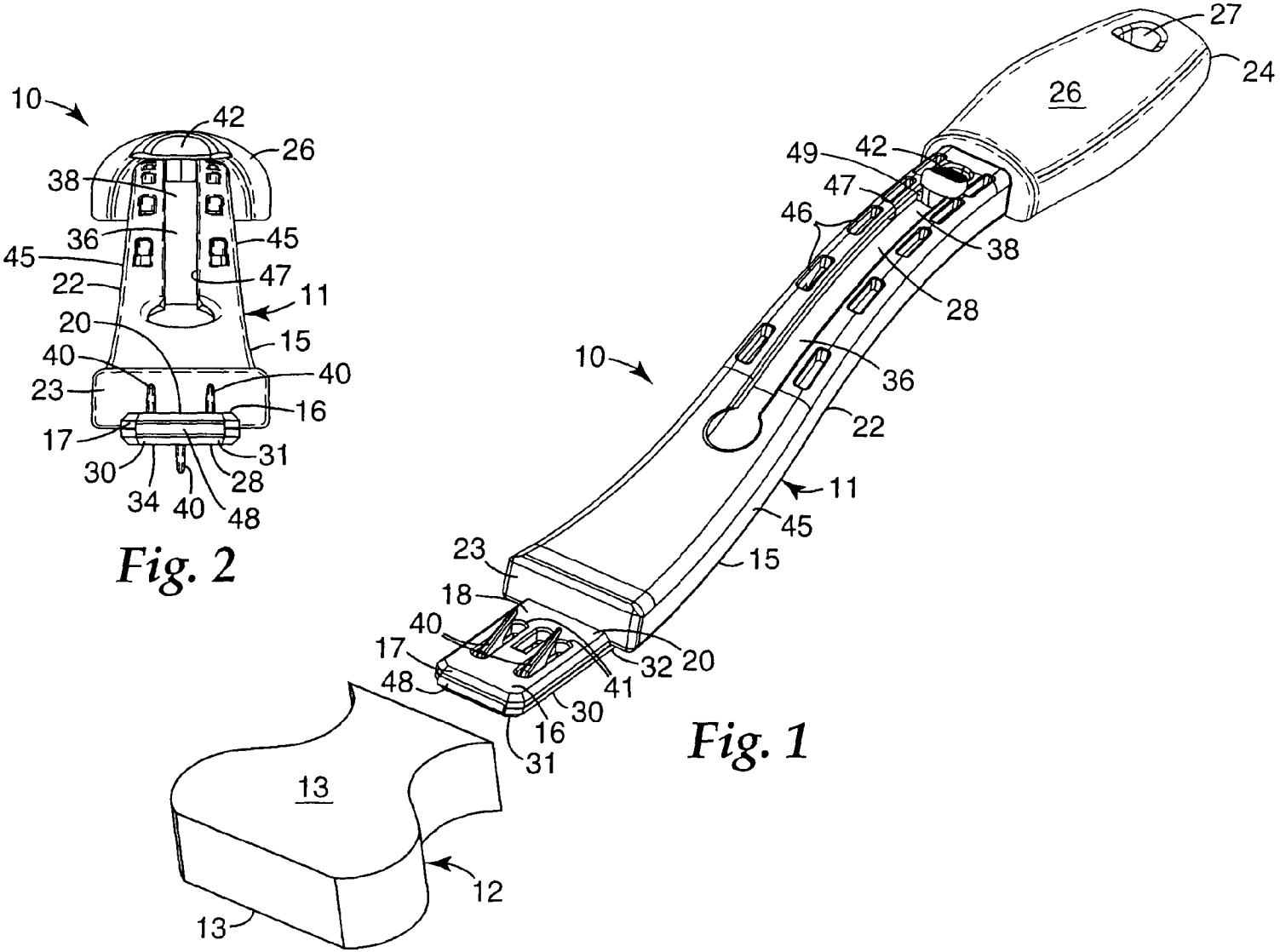
FIG. 1 is a perspective view of a first embodiment of a cleaning device according to the present invention, which cleaning device includes a reusable handle assembly and a disposable pad shown separated from the handle assembly, and in which view insertable portions of the handle assembly are in an adjacent position.
FIG. 2 is an enlarged front view of the handle assembly of FIG. 1.
Figure 3:
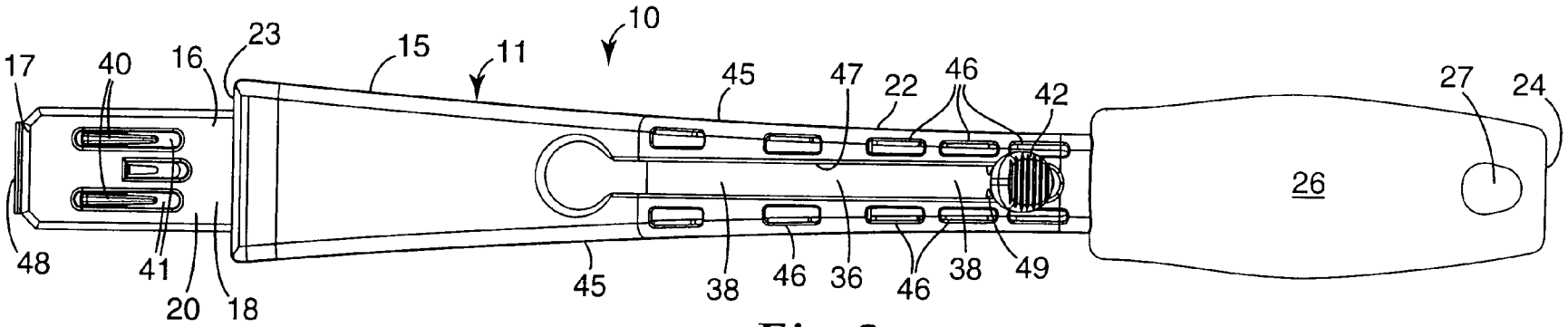
FIG. 3 is an enlarged top view of the handle assembly of FIG. 1.
Figure 4:
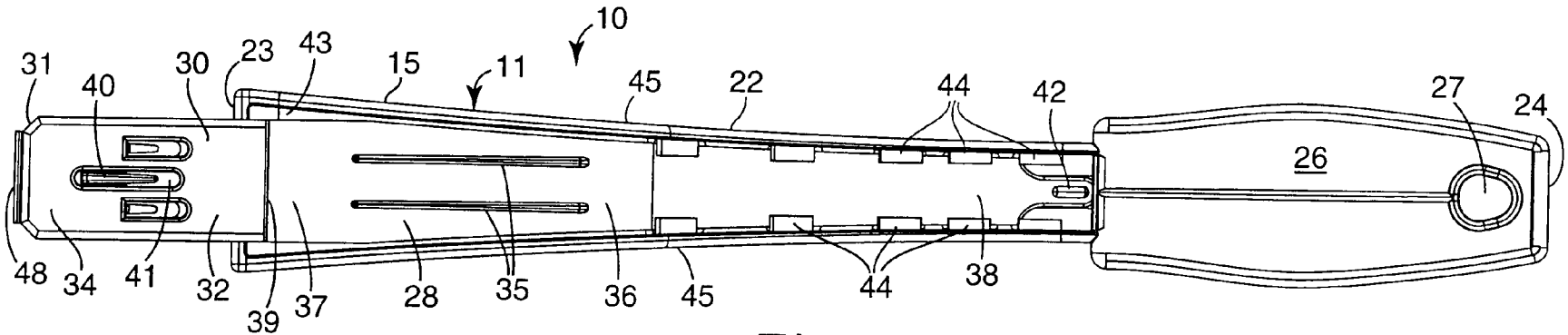
FIG. 4 is an enlarged bottom front view of the handle assembly of FIG. 1.

Referring to FIGS. 1 through 9 of the drawing there is illustrated a first embodiment of a cleaning device 10 according to the present invention, which cleaning device 10 includes a handle assembly 11 and a disposable cleaning pad 12.

The cleaning pad 12 is a pad of stiff resiliently flexible fibrous material (e.g., preferably a pad of non-woven polymeric fibers such as the material sold under the trade designation "Scotchbrite" by 3M Company, St. Paul, Minn., although other materials could be used), to which fibers may be adhered an abrasive which helps to clean but will not scratch toilet bowls, (e.g., the abrasive mineral commercially designated "Minex" that is available from Cary Co., Adison, Ill.). The cleaning pad or pad 12 has opposite parallel generally omega shaped major surfaces 13 and has contacting or closely spaced inner surfaces midway between and parallel to its major surfaces 13 that define a slot or slit 14 opening only through one edge surface of the cleaning pad 12. The cleaning pad 12 may, optionally, be impregnated with all or any one or ones of a cleaning material (e.g., soap), a dye, and a fragrance.

The handle assembly 11 includes a stiff first member 15 (e.g., molded of a polymeric material such as polypropylene). The first member 15 includes an elongate first insertable portion 16 having opposite first and second ends 17 and 18 and opposite generally parallel inner and outer surfaces 19 and 20 extending between its first and second ends 17 and 18; and an elongate handle portion 22 having opposite first and second ends 23 and 24. The first end 23 of the handle portion 22 is fixed to the second end 18 of the first insertable portion 16. The handle portion 22 has a manually engageable part 26 adjacent its second end 24, which has a through opening 27 by which the handle assembly 11 can be hung from a projection.

The handle assembly 11 also includes a second member 28 (e.g., also molded of a polymeric material such as polypropylene) including a stiff elongate second insertable portion 30 having opposite first and second ends 31 and 32 and opposite generally parallel inner and outer surfaces 33 and 34 extending between its first and second ends 31 and 32, and an elongate actuation portion 36 having opposite first and second ends 37 and 38 that includes a part that is resiliently flexible adjacent its second end 38, and has longitudinally extending reinforcing ribs 35 to stiffen a part thereof adjacent its first end 37. The first end 37 of the actuation portion 36 is fixed to the second end 32 of the second insertable portion 30 by a hinge 39 of the type called a "living hinge" which is a thin flexible section of polymeric material joining the second first end 37 of the actuation portion 36 and the second end 32 of the second insertable portion 30.

Figure 7:
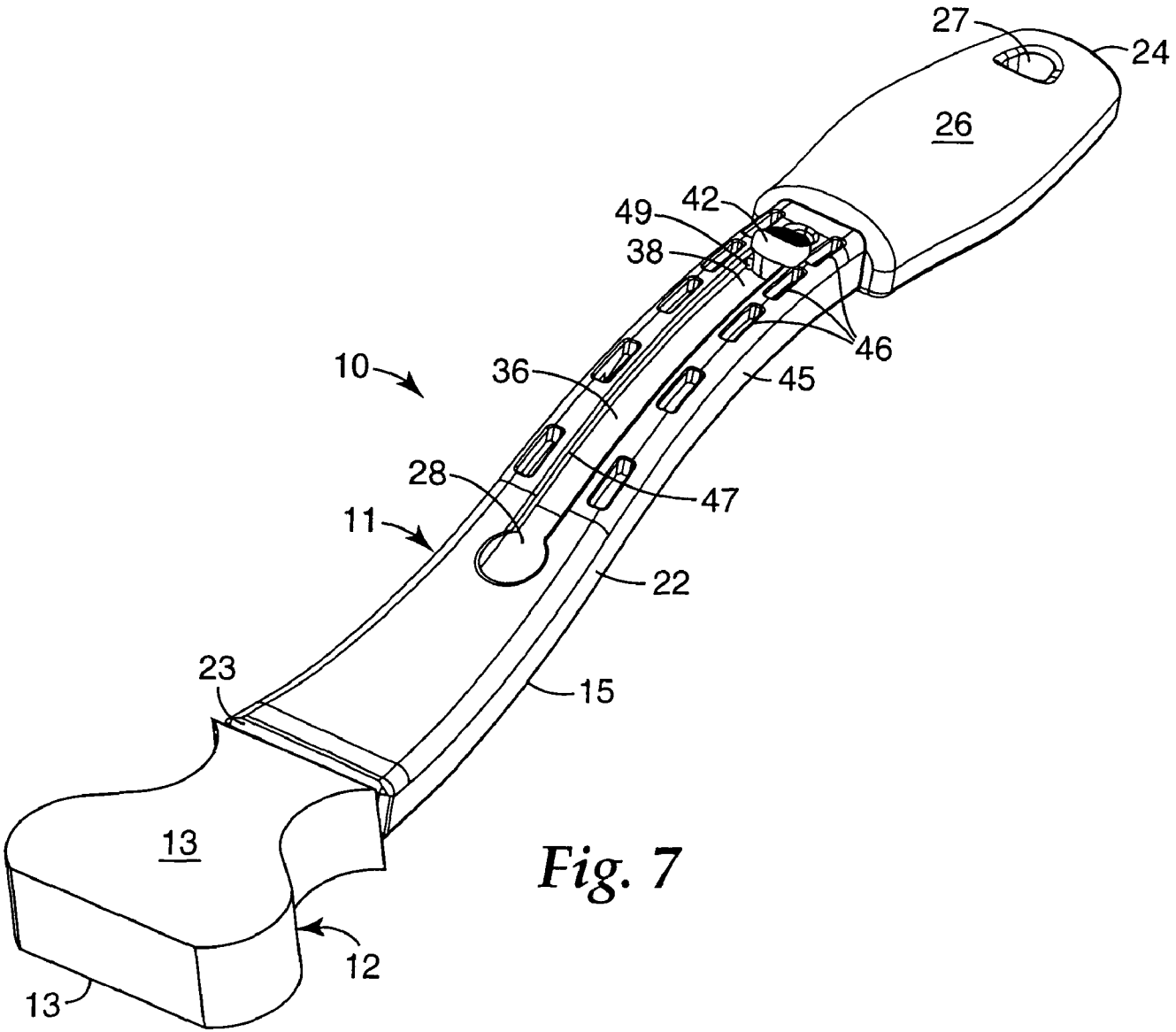
FIG. 7 is a perspective view of the cleaning device of FIG. 1 in which the insertable portions of the handle assembly are in their adjacent position and the disposable pad is mounted on the handle assembly.
Figure 8:
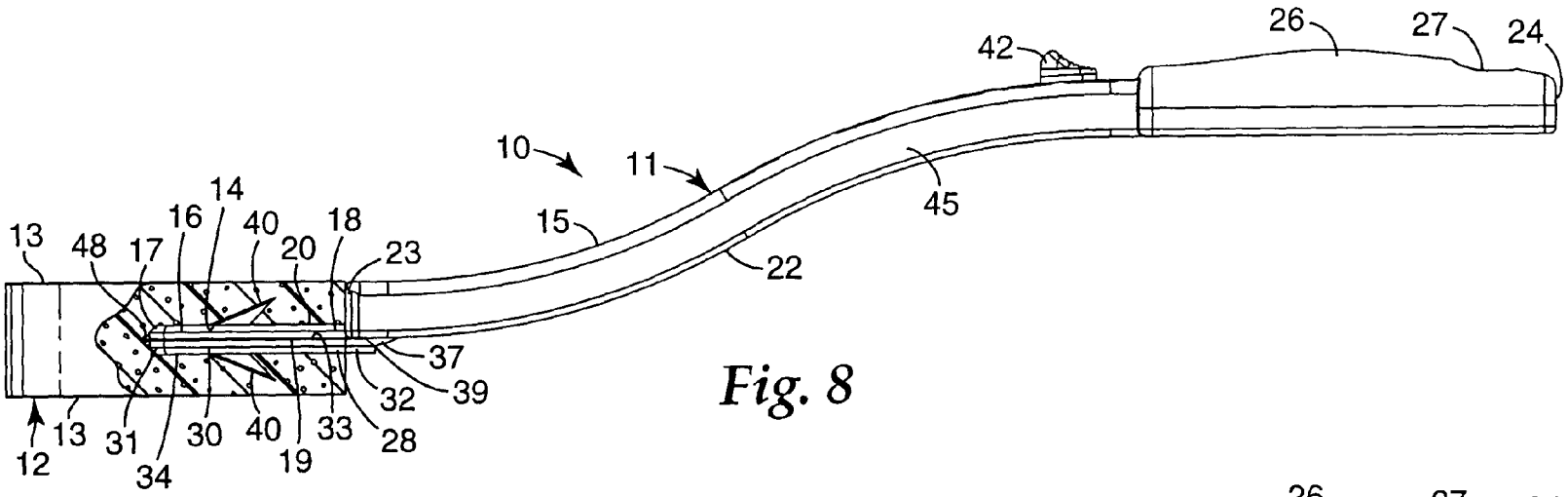
FIG. 8 is an enlarged side view of the cleaning device of FIG. 1 with part of the disposable pad broken away to show detail, in which view the insertable portions of the handle assembly are in their adjacent position and the disposable pad is mounted on the handle assembly.

The first end 31 of the second insertable portion 30 is pivotally mounted on the first end 17 of the first insertable portion 16 with the inner surfaces 19 and 33 of the insertable portions 16 and 30 adjacent for relative movement of the insertable portions 16 and 30 by manipulation of the actuation portion 36 between a diverging position or positions (FIGS. 5 and 9) with the outer surfaces 20 and 34 of the insertable portions 16 and 30 diverging from the first ends 17 and 31 of the insertable portions 16 and 30 (e.g., at an angle of at least about 15 degrees and in the range of about 15 degrees to 30 degrees), and an adjacent position (FIGS. 1 through 4, 7 and 8). In the adjacent position the outer surfaces 20 and 34 of the insertable portions 16 and 30 are generally parallel (i.e., by generally parallel we mean the surfaces can be parallel, can be tapered slightly with respect to each, other or could be slightly arcuate about transverse or longitudinal axes, or could have other slight irregularities) and/or in the adjacent position the outer surfaces 20 and 34 are closer to parallel than in the diverging position by at least 10 degrees, and preferably by at least 15 degrees. Each of the insertable portions 16 and 30 has at least one barb 40 projecting from its inner surface 19 or 33 (as illustrated, the first insertable portion 16 has one barb 40 and the second insertable portion 30 has two barbs 40 flanking the barb 40 on the first insertable portion 16), and the other of the insertable portions 30 or 16 has a through opening or slot 41 aligned with each barb 40. The barbs 40 project above the outer surfaces 20 and 34 of the insertable portions 16 and 30 through which they project in the adjacent position of the insertable portions 16 and 30. Thus with the insertable portions 16 and 30 in their adjacent position and within the slit 14 in the cleaning pad 12 as illustrated in FIGS. 7 and 8, the barbs 40 will engage the cleaning pad 12. The barbs 40, however are essentially positioned between the outer surfaces 20 and 34 of the insertable portions 16 and 30 in their diverging position (FIGS. 5 and 9) so that the insertable portions 16 and 30 can then move within the slit 14 relative to the cleaning pad 12 without significant contact between the barbs 40 and the cleaning pad 12. The barbs 40 project or are inclined toward the second ends 18 and 32 of the insertable portions 16 and 30 so that the insertable portions 16 and 30 can be moved into the slit 14 in the cleaning pad 12 with the insertable portions 16 and 30 in their adjacent position. During such movement of the insertable portions 16 and 30 into the slit 14 the outer inclined surfaces of the barbs 40 will provide a cam-like separation of the inner surfaces of the cleaning pad 12 defining the slit 14. The outer inclined surface of each barb 40 is disposed at an acute angle (e.g., about 23 degrees) with respect to the inner surface of the insertable portion 16 or 30 from which the barb 40 projects to easily provide that cam-like separation, and the angle between that outer inclined surface and the opposite inner surface on each barb 40 (e.g., about 23 degrees) provides a sharp point on the barb 40 that will engage and hold the cleaning pad 12 in place on the insertable portions 16 and 30.

Figure 5:
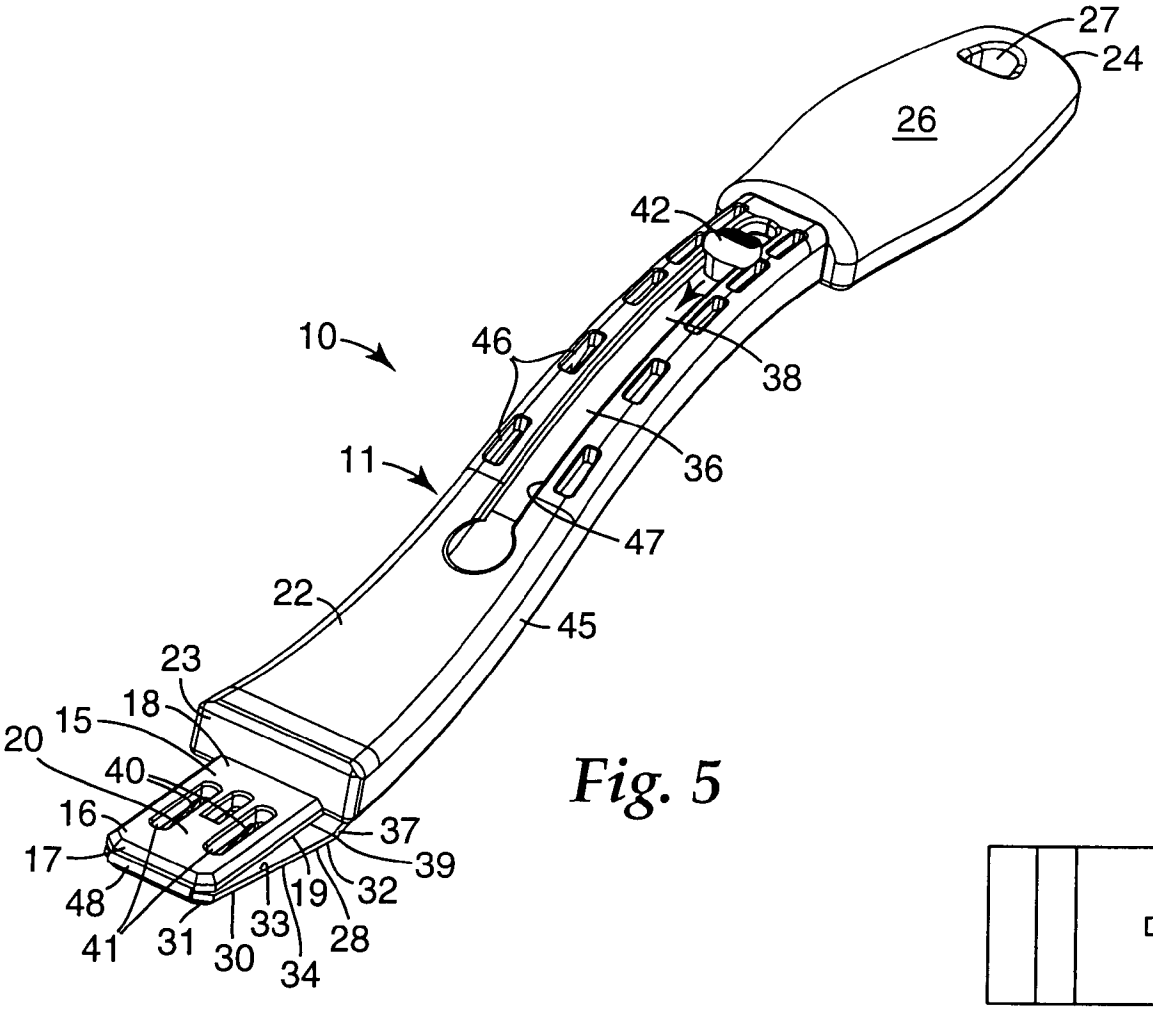
FIG. 5 is a perspective view of the handle assembly of FIG. 1 in which insertable portions of the handle assembly are in a diverging position.
Figure 6:
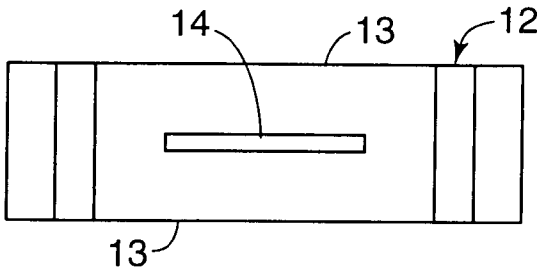
FIG. 6 is an enlarged rear view of the disposable pad of FIG. 1.
Figure 9:
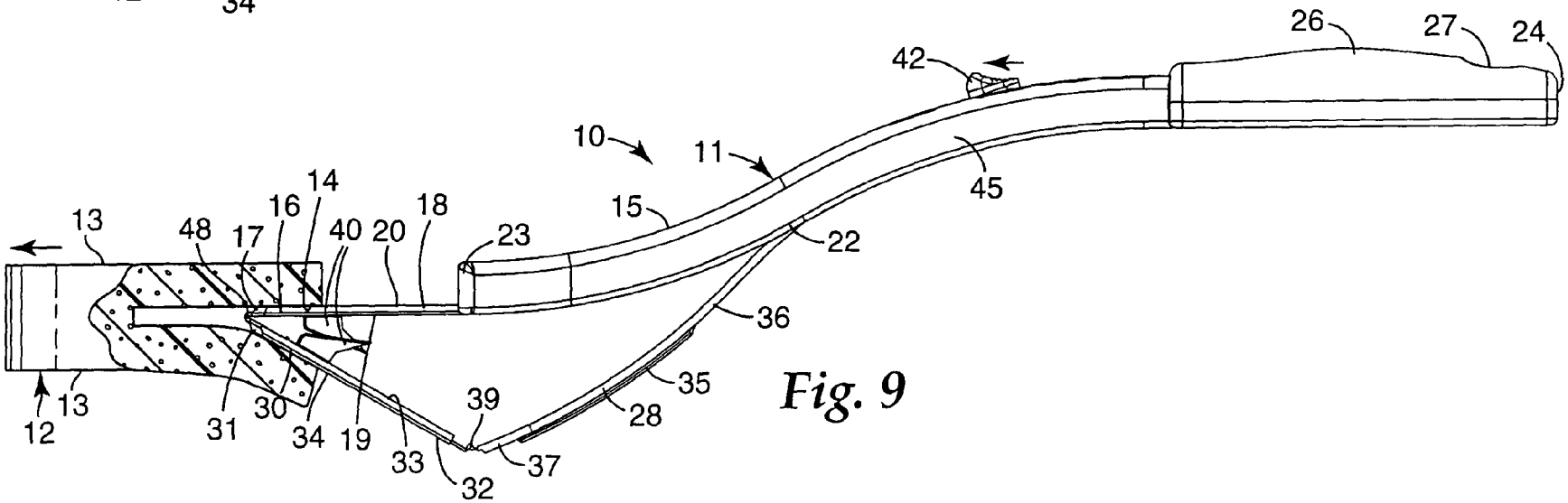
FIG. 9 is an enlarged side view of the cleaning device of FIG. 1 with part of the disposable pad broken away to show detail, in which view the insertable portions of the handle assembly are in their diverging position and the disposable pad is being separated from the handle assembly.
Figure 10:
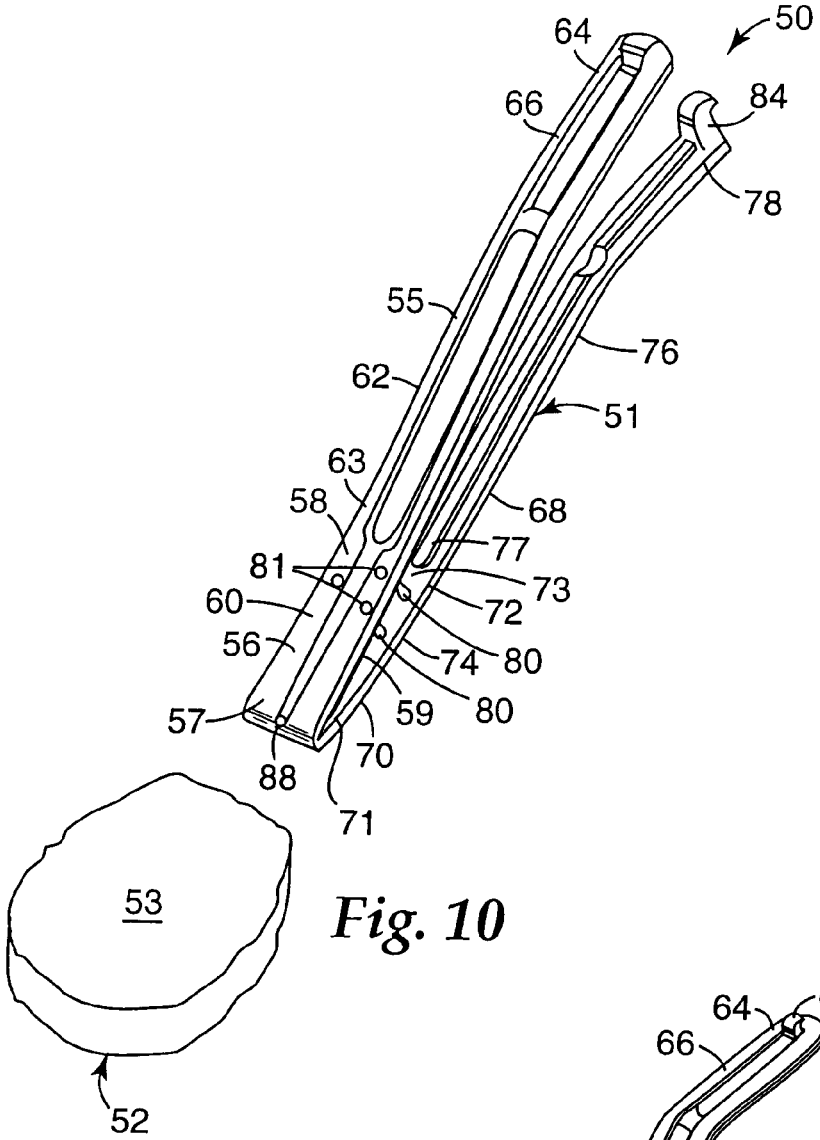
FIG. 10 is a perspective view of a second embodiment of a cleaning device according to the present invention, which cleaning device includes a reusable handle assembly and a disposable pad shown separated from the handle assembly, and in which view insertable portions of the handle assembly are in a diverging position.
Figure 11:
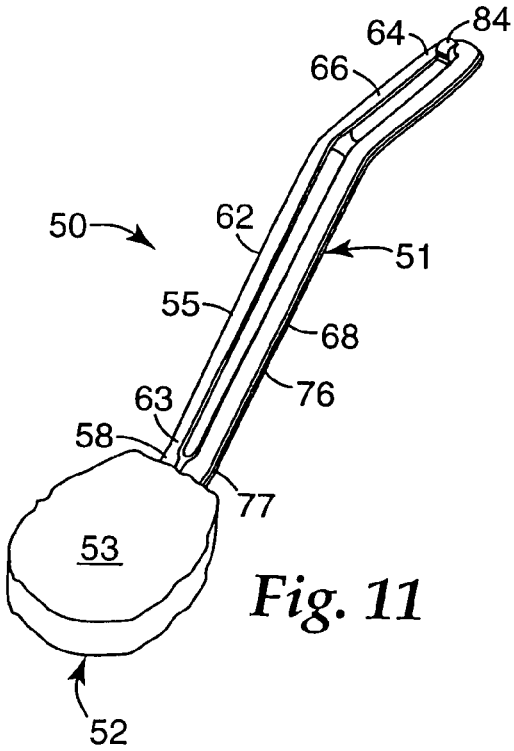
FIG. 11 is a reduced perspective view of the cleaning device of FIG. 10 in which the insertable portions of the handle assembly are in an adjacent position and the disposable pad is mounted on the handle assembly.

The actuation portion 36 of the second member 28 is mounted for sliding movement along the handle portion 22 between a closed position to position the insertable portions 16 and 30 in their adjacent position (FIGS. 1 through 4, 7 and 8), and an open position with the first end 37 of the actuation portion 36 closer to the insertable portions 16 and 30 than in the closed position to position the insertable portions 16 and 30 in their diverging position (FIGS. 5 and 9). The actuation portion 36 has a manually engageable member or button 42 that can be manually moved along the handle portion 22 by the thumb of a person grasping the manually engageable part 26 to afford movement of the insertable portions 16 and 30 between their adjacent and diverging positions.

The first and second members 15 and 28 can be integrally molded in one piece with the first end 31 of the second insertable portion 30 pivotally mounted on the first end 17 of the first insertable portion 16 by a hinge 48 of the type called a "living hinge" which is a thin flexible section of polymeric material joining the first ends 17 and 31 of the insertable portions 16 and 30. Alternatively, the first and second members 15 and 28 could be separately molded and the hinge 48 could be of a different type, such as a hinge having a central cylindrical portion transversely fixed on the first end 17 or 31 of one of the insertable portions 16 or 30 flanked by and aligned with two spaced cylindrical portions transversely fixed on the first end 31 or 17 of the other insertable portion 30 or 16, which hinge further includes a hinge pin extending through central openings in those three cylindrical portions.

The flexible plate like part of the actuation portion 36 adjacent its second end 38 is mounted for sliding movement along the handle portion 22 between an inner surface 43 of a top wall included in the handle portion 22 and opposed tabs 44 projecting from opposite side walls 45 included in the handle portion 22. The top wall has openings 46 aligned with the tabs 44 that facilitate molding the tabs 44 along the side walls 45. The manually engageable button 42 has a narrow portion projecting from the actuation portion 36 that is sufficiently narrow so that it can slide along an elongate slot 47 extending centrally along and through the top wall and inner surface 43 of the handle portion 22. The button 42 also has a distal head larger that its narrow portion that slides along the outer surface of the top wall. The slot 47 extends past the tabs 44 toward the first end 23 of the handle portion 22 and has an enlarged opening adjacent the first end 23 of the handle portion 22 through which the distal head of the button 42 can pass. To assemble the handle assembly 11 from a unitary molding including the first and second members 15 and 28, the head of the manually engageable button 42 (which is adjacent the second end 38 of the actuation portion 36) is moved through the enlarged opening in the slot 47 adjacent the first end 23 of the handle portion 22 and slid along the slot 47 toward the second end 24 of the handle portion 22 so that the flexible end part of the actuation portion 36 moves between the tabs 44 and the inner surface 43. Opposed projections 49 spaced a short distance from the end of the slot 47 adjacent the second end 24 of the handle portion 22 and spaced apart so that they will interfere with, but not prevent passage of, the narrow portion of the button 42 provide a tactile indication when passed that the button 42 has reached a position at which the insertable portions 16 and 30 are in their adjacent position. The opposed projections 49 also help to releasably retain the button 42 at its position with the insertable portions 16 and 30 in their adjacent position. Subsequently, manual movement of the button 42 toward the first end 23 of the handle portion 22 will cause relative pivotal movement of the insertable portions 16 and 30 from their adjacent position (FIGS. 1 through 4, 7 and 8) to their diverging position (FIGS. 5 and 9).

To use the cleaning device 10 a user can first insert the insertable portions 16 and 30 into the slit 14 in the cleaning pad 12 which can be done with the insertable portions 16 and 30 in their adjacent position, thereby causing the sloped outer surfaces of the barbs 40 to move along and spread the surfaces of the cleaning pad 12 defining the slit 14 until a ledge at the first end 23 of the handle portion 22 abuts the side surface of the cleaning pad 12 (FIGS. 7 and 8). The cleaning pad 12 is then retained in that position by and between the barbs 40 and the ledge during use of the combination 10 for cleaning purposes (e.g., such to clean a toilet bowl). When the user desires to remove the cleaning pad 12 he or she simply moves the insertable portions 16 and 30 to their diverging position (FIGS. 5 and 9) by manually engaging and moving the member 42 along the handle portion 22 a short distance toward the insertable portions 16 and 30. As the insertable portions 16 and 30 are thus moved toward their diverging position the outer surfaces 20 and 34 of the insertable portions 16 and 30 will spread the surfaces of the cleaning pad 12 defining the slit 14 and move the cleaning pad 12 out of engagement with the barbs 40, which barbs 40 will then become positioned between the outer surfaces 20 and 34 of the insertable portions 16 and 30. In their diverging position the outer surfaces 20 and 34 of the insertable portions 16 and 30 are disposed in a wedge like shape (i.e., at an angle of at least about 15 degrees and in the range of about 15 to 30 degrees) with the apex of the wedge like shape at the first ends 17 and 31 of the insertable portions 16 and 30. This wedge like shape of the outer surfaces 20 and 34 and the resilient flexibility of the cleaning pad 12 can cause the cleaning pad 12 to slide off of the insertable portions 16 and 30 with little or no external contact. Thus the dirty cleaning pad 12 can be removed from the handle assembly 11 without contact by the user.

As a non-limiting example, the insertable portions 16 and 30 can each have a length of about 1.75 inch or 4.45 cm, a width of about 1 inch or 2.54 cm, and a thickness of about 0.15 inch or 0.38 cm, and the points of the barbs 40 can be about 0.25 inch or 0.64 cm above the outer surface 20 or 34 of the insertable portion 16 or 30 through which they project when the insertable portions 16 and 30 are in their adjacent position.

Referring to FIGS. 10 through 14 of the drawing there is illustrated a second embodiment of a cleaning device 50 according to the present invention, which cleaning device 50 includes the combination of a handle assembly 51 and a disposable cleaning pad 52.

The cleaning pad 52 is a pad of stiff resiliently flexible fibrous material (e.g., a pad of the same material described above for the pad 12). The cleaning pad 52 has opposite parallel major generally oval shaped major surfaces 53 and has contacting or closely spaced inner surfaces midway between and parallel to its major surfaces 53 that define a slot or slit 54 opening only through one side surface of the cleaning pad 52. The cleaning pad 52 may optionally be impregnated with one or more of the same materials noted above that can be used with the cleaning pad 12.

Figure 12:
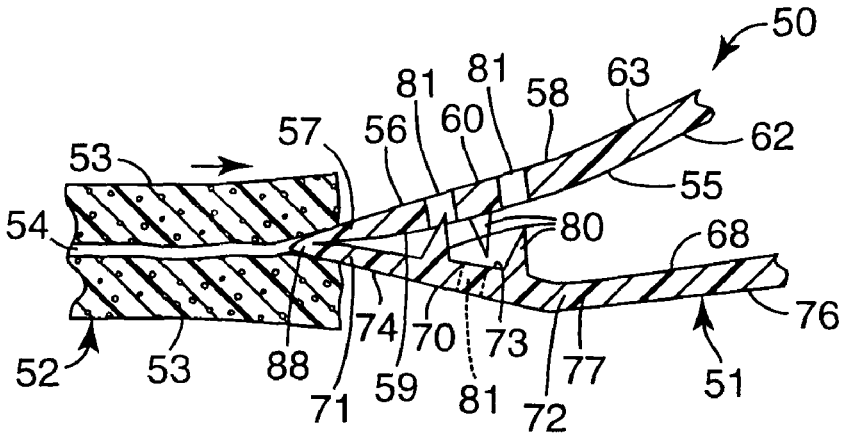
FIG. 12 is an enlarged fragmentary longitudinal vertical sectional view of the cleaning device of FIG. 1 in which view the insertable portions of the handle assembly are in their diverging position and the disposable pad is being mounted on the handle assembly.
Figure 13:
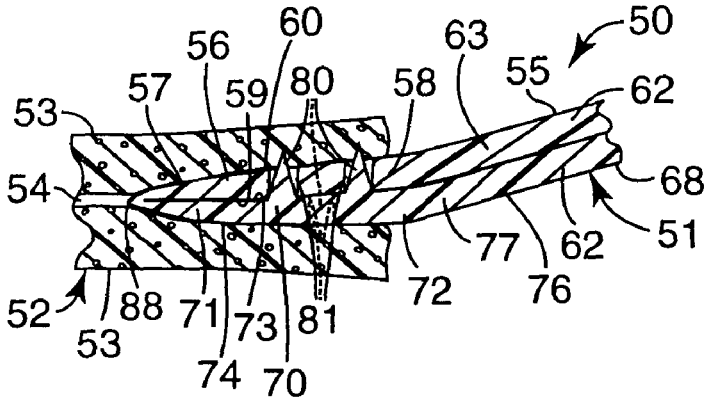
FIG. 13 is an enlarged fragmentary longitudinal vertical sectional view of the cleaning device of FIG. 1 in which view the insertable portions of the handle assembly are in their adjacent position and the disposable pad is mounted on the handle assembly.

The handle assembly 51 includes a stiff first member 55 (e.g., molded of a polymeric material such as polypropylene). The first member 55 includes an elongate first insertable portion 56 having opposite first and second ends 57 and 58 and opposite generally parallel inner and outer surfaces 59 and 60 extending between its first and second ends 57 and 58; and an elongate handle portion 62 having opposite first and second ends 63 and 64. The first end 63 of the handle portion 62 is fixed to the second end 58 of the first insertable portion 56. The handle portion 62 has a manually engageable part 66 adjacent its second end 64. The handle assembly 51 also includes a stiff second member 68 (e.g., also of a polymeric material such as polypropylene). The second member includes an elongate second insertable portion 70 having opposite first and second ends 71 and 72 and opposite generally parallel inner and outer surfaces 73 and 74 extending between its first and second ends 71 and 72, and a stiff elongate actuation portion 76 having opposite first and second ends 77 and 78. The first end 77 of the actuation portion 76 is fixed to the second end 72 of the second insertable portion 70. The first end 71 of the second insertable portion 70 is pivotally mounted on the first end 57 of the first insertable portion 56 with the inner surfaces 59 and 73 of the insertable portions 56 and 70 adjacent for relative movement of the insertable portions 56 and 70 by manipulation of the actuation portion 76 between a diverging position (FIGS. 10, 12, and 14) with the outer surfaces 60 and 74 of the insertable portions 56 and 70 diverging from the first ends 57 and 71 of the insertable portions 56 and 70 (e.g., at an angle in the range of at least about 15 degrees and in the range of about 15 to over 30 degrees), and an adjacent position (FIGS. 11 and 13) with the outer surfaces 60 and 74 of the insertable portions 56 and 70 generally parallel and/or closer to parallel than in the diverging position by at least 10 degrees, and preferably by at least 15 degrees. Each of the insertable portions 56 and 70 has at least one barb 80 projecting from its inner surface 59 or 73 (as illustrated, the first insertable portion 56 has one barb 80 and the second insertable portion 70 has two barbs 80 flanking the barb 80 on the first insertable portion 56), and the other of the insertable portions 70 or 56 has a through opening 81 aligned with the barb 80. The barbs 80 project above the outer surfaces 60 and 74 of the insertable portions 56 and 70 through which they project in the adjacent position of the insertable portions 56 and 70 so that with the insertable portions 56 and 70 in their adjacent position and in the slit 54 in the cleaning pad 52 as seen in FIG. 13 the barbs 80 will engage the cleaning pad 52. The barbs 80, however, are essentially positioned between the outer surfaces 60 and 74 of the insertable portions 56 and 70 in their diverging position so that the insertable portions 56 and 70 can then move in the slit 54 relative to the cleaning pad 52 without contact between the barbs 80 and the cleaning pad 52. Each of the barbs 80 projects at about a right angle with respect to the inner surface 59 or 73 from which it projects so that the insertable portions 56 and 70 must be moved into the slit 54 in the cleaning pad 52 with the insertable portions 56 and 70 in their diverging position (FIG. 12). This will spread the surfaces of cleaning pad 52 defining the slit 54, however, the resiliently flexible nature of the material from which the cleaning pad 52 is made will cause the surfaces defining the slit 54 to follow the outer surfaces 60 and 74 of the insertable portions 56 and 70 when the insertable portions 56 and 70 are subsequently returned to their adjacent position so that the barbs 80 will then engage the cleaning pad 52.

The actuation portion 76 of the second member 68 is a generally rigid member manually moveable between a closed position laying along the handle portion 62 to position the insertable portions 56 and 70 in their adjacent position (FIGS. 11 and 13), and an open position (FIGS. 10, 12, and 14) spaced from the handle portion 62 to position the insertable portions 56 and 70 in their diverging position. The handle assembly 51 includes means for releasably latching the handle and actuation portions 62 and 76 in the closed position. As illustrated that means for releasably latching is a stiff resiliently flexible projection 84 at the second end 78 of the actuation portion 76 adapted to releasably engage over the second end 64 of the handle portion 62, however many other types of means for releasably latching could be provided.

The first end 71 of the second insertable portion 70 is pivotally mounted on the first end 57 of the first insertable portion 56 by a hinge 88. The hinge 88 could be the type called a "living hinge" which is a thin strip of polymeric material joining the insertable portions 56 and 70 if the first and second members 55 and 68 are integrally molded. Alternatively, the hinge 88 could be of any other suitable type such a hinge having a central cylindrical portion transversely fixed on the first end 57 or 71 of one of the insertable portions 56 or 70 flanked by and aligned with two spaced cylindrical portions transversely fixed on the first end 71 or 57 of the other insertable portion 70 or 56, which hinge further includes a hinge pin extending through central openings in those three cylindrical portions.

Figure 14:
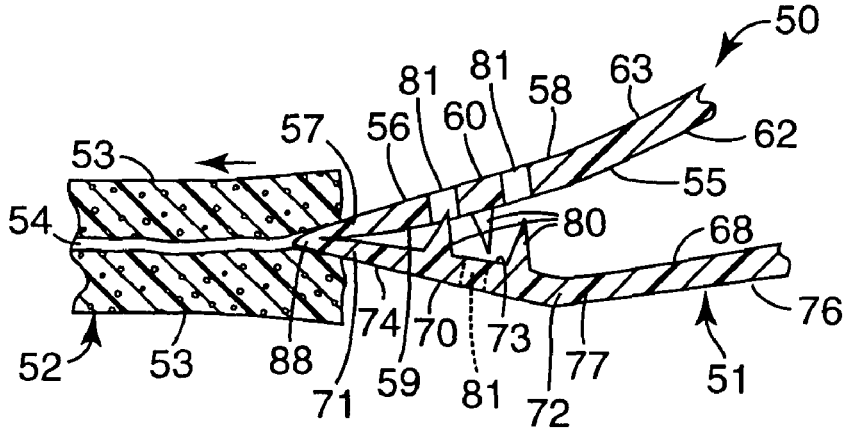
FIG. 14 is an enlarged fragmentary longitudinal vertical sectional view of the cleaning device of FIG. 1 in which view the insertable portions of the handle assembly are in their diverging position and the disposable pad is being removed from the handle assembly.

To use the cleaning device 50 a user first moves the insertable portions 56 and 70 to their diverging position by releasing the latching projection 84 between the actuation portion 76 and handle portion 62 and moving the actuation portion 76 away from the handle portion 62. The user then inserts the insertable portions 56 and 70 into the slit 54 in the cleaning pad 52 with the insertable portions 56 and 70 in their diverging position (FIG. 12) until the first end 63 of the handle portion 62 is at the side surface of the cleaning pad 52 (this will cause some spreading of the surfaces defining the slit 54 in the cleaning pad). The user then moves the actuation portion 76 toward the handle portion 62 and engages the latching projection 84 between them which allows the surfaces defining the slit 54 to follow the outer surfaces 60 and 74 of the insertable portions 56 and 70 and the barbs 80 to engage the cleaning pad 52 (FIG. 13) so that the cleaning pad 52 is then retained in that position by the barbs 80 during use of the combination 50 for cleaning purposes (e.g., such to clean a toilet bowl). When the user desires to remove the cleaning pad 52 he or she again moves the insertable portions 56 and 70 to their diverging position by releasing the latching projection 84 between the actuation portion 76 and handle portion 62 and moving the actuation portion 76 away from the handle portion 62 (FIG. 14). As the insertable portions 56 and 70 are thus moved toward their diverging position the outer surfaces 60 and 74 of the insertable portions 56 and 70 will spread the surfaces of the cleaning pad 52 defining the slit 54 and move the cleaning pad 52 out of engagement with the barbs 80, which barbs will become positioned between the outer surfaces 60 and 74 of the insertable portions 56 and 70. The outer surfaces 60 and 74 of the insertable portions 56 and 70 in their diverging position are disposed in a wedge like shape with its apex at the first ends 57 and 71 of the insertable portions 56 and 70. This wedge like shape of the outer surfaces 20 and 74 will cause the cleaning pad 52 to slide off of the insertable portions 56 and 70. Thus the dirty cleaning pad 52 can be removed from the handle assembly 51 without contact by the user.

The present invention has now been described with reference to two embodiments. It will be apparent to those skilled in the art that many changes can be made in the embodiments described without departing from the scope of the present invention. For example, insertable portions 16 and 30 with barbs 40 shaped like those described above with reference to the handle assembly 11 can be substituted for the insertable portions 56 and 70 on the handle assembly 51. That substitution would provide the advantage over the handle assembly 51 as described above that the insertable portions 16 and 30 could remain in their adjacent position when they are inserted into the slot 14 or 54 in the cleaning pad 12 or 52. Thus, the scope of the present invention should not be limited to the structures and methods described in this application, but only by the structures and methods described by the language of the claims and the equivalents thereof.

What is claimed is:

1. A handle assembly for use with a cleaning pad having a slit opening through a side surface of the cleaning pad, said handle assembly comprising:

a first member including a first insertable portion having opposite first and second ends and opposite inner and outer surfaces extending between said first and second ends, and a handle portion having opposite first and second ends, the first end of said handle portion being fixed to the second end of said first insertable portion and said handle portion having a manually engageable part adjacent the second end of said handle portion;

a second member including a second insertable portion having opposite first and second ends and opposite inner and outer surfaces extending between said first and second ends, and an actuation portion having opposite first and second ends, the first end of said actuation portion being fixed to the second end of said second insertable portion;

the first end of said second insertable portion being pivotally mounted on the first end of said first insertable portion with the inner surfaces of said insertable portions adjacent for relative movement of said insertable portions by manipulation of said actuation portion between a diverging position with said outer surfaces of said insertable portions diverging from said first ends of said insertable portions, and an adjacent position with said outer surfaces of said insertable portions generally parallel or closer to parallel than in said diverging position;

at least one of said insertable portions having at least one barb projecting from the inner surface of said one insertable portion, and the other of said insertable portions having an opening aligned with said barb, said barb projecting above the outer surface of said other of said insertable portions in said adjacent position so that with the insertable portions in the slit in the cleaning pad the barb will engage the cleaning pad, and said barb being essentially positioned between the outer surfaces of said insertable portions in said diverging position so that the insertable portions can move in the slit relative to the cleaning pad.

2. A handle assembly according to claim 1 wherein each of said insertable portions has at least one barb projecting from the inner surface of said insertable portion, and the other of said insertable portions has an opening aligned with said barb, said barbs projecting above the outer surfaces of said insertable portions in said adjacent position so that with the insertable portions in the slit in the cleaning pad the barbs will engage the cleaning pad, and said barbs being essentially positioned between the outer surfaces of said insertable portions in said diverging position so that the insertable portions can move in the slit relative to the cleaning pad.

3. A handle assembly according to claim 1 wherein one of said insertable portions has two barbs projecting from the inner surface of said one insertable portion, the other of said insertable portions has one barb projecting from the inner surface of said other of said insertable portions, and each of the insertable portions has one or more openings aligned with the barb or barbs on the other of the insertable portions, said barbs projecting above the outer surfaces of said insertable portions in said adjacent position so that with the insertable portions in the slit in the cleaning pad the barbs will engage the cleaning pad, and said barbs are essentially positioned between the outer surfaces of said insertable portions in said diverging position so that the insertable portions can move in the slit relative to the cleaning pad.

4. A handle assembly according to claim 3 wherein said barbs project toward the second end of said insertable portions so that said insertable portions can be moved into the slit in the cleaning pad with said insertable portions in said adjacent position.

5. A handle assembly according to claim 1 wherein in said diverging position the outer surfaces of said insertable portions are disposed at an angle in the range of about 15 to 30 degrees.

6. A handle assembly according to claim 1 wherein said actuation portion is a generally rigid member manually moveable between a closed position laying along said handle portion to position said insertable portions in said adjacent position, and an open position spaced from said handle portion to position said insertable portions in said diverging position, and said handle assembly includes means for releasably latching said handle and actuation portions in said closed position.

7. A handle assembly according to claim 1 wherein said actuation portion is mounted for sliding movement along said handle portion between a closed position to position said insertable portions in said adjacent position, and an open position with the first end of said actuation portion closer to said insertable portions than in said closed position to position said insertable portions in said diverging position, said actuation portion including a manually engageable button moveable along said handle member to afford manual movement of said insertable portions between said adjacent and open positions.

8. A handle assembly for use with a cleaning pad having a slit opening through a side surface of the cleaning pad, said handle assembly comprising:

a first member including a first insertable portion having opposite first and second ends and opposite inner and outer surfaces extending between said first and second ends, and a handle portion having opposite first and second ends, the first end of said handle portion being fixed to the second end of said first insertable portion and said handle portion having a manually engageable part adjacent the second end of said handle portion;

a second member including a second insertable portion having opposite first and second ends and opposite inner and outer surfaces extending between said first and second ends, and an actuation portion having opposite first and second ends, the first end of said actuation portion being fixed to the second end of said second insertable portion;

the first end of said second insertable portion being pivotally mounted on the first end of said first insertable portion with the inner surfaces of said insertable portions adjacent for relative movement of said insertable portions by manipulation of said actuation portion between a diverging position with said outer surfaces of said insertable portions diverging from said first ends of said insertable portions, and an adjacent position with said outer surfaces of said insertable portions generally parallel or closer to parallel than in said diverging position;

each of said insertable portions having at least one barb projecting from the inner surface of said insertable portion, and the other of said insertable portions having an opening aligned with said barb, said barbs projecting above the outer surfaces of said insertable portions in said adjacent position so that with the insertable portions in the slit in the cleaning pad the barbs will engage the cleaning pad, and said barbs being essentially positioned between the outer surfaces of said insertable portions in said diverging position so that the insertable portions can move in the slit relative to the cleaning pad, said barbs projecting toward the second end of said insertable portions so that said insertable portions can be moved into the slit in the cleaning pad with said insertable portions in said adjacent position.

9. A handle assembly according to claim 8 wherein in said diverging position the outer surfaces of said insertable portions are disposed at an angle of at least about 15 degrees.

10. A handle assembly according to claim 8 wherein in said diverging position the outer surfaces of said insertable portions are disposed at an angle in the range of about 15 to 30 degrees.

11. A handle assembly according to claim 8 wherein in said diverging position the outer surfaces are closer to parallel than in the diverging position by at least 10 degrees.

12. A handle assembly according to claim 8 wherein in said diverging position the outer surfaces are closer to parallel than in the diverging position by at least 15 degrees.

13. A handle assembly according to claim 8 wherein said actuation portion is a generally rigid member manually moveable between a closed position laying along said handle portion to position said insertable portions in said adjacent position, and an open position spaced from said handle portion to position said insertable portions in said diverging position, and said handle assembly includes means for releasably latching said handle and actuation portions in said closed position.

14. A handle assembly according to claim 8 wherein said actuation portion is mounted for sliding movement along said handle portion between a closed position to position said insertable portions in said adjacent position, and an open position with the first end of said actuation portion closer to said insertable portions than in said closed position to position said insertable portions in said diverging position, said actuation portion having a manually engageable button moveable along said handle member to afford manual movement of said insertable portions between said adjacent and open positions.

15. A handle assembly according to claim 8 wherein in said first and second members are a unitary molding.

* * * * *